US009196994B2

(12) United States Patent
Tseng et al.

(10) Patent No.: US 9,196,994 B2
(45) Date of Patent: Nov. 24, 2015

(54) CONNECTOR MECHANISM AND RELATED ELECTRONIC DEVICE

(71) Applicant: Wistron Corporation, New Taipei (TW)

(72) Inventors: Tien-Chung Tseng, New Taipei (TW); Po-Lun Lin, New Taipei (TW); Chih-Peng Chen, New Taipei (TW); Chih-Sheng Chou, New Taipei (TW); Chia-Jou Chen, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 0 days.

(21) Appl. No.: 13/928,402

(22) Filed: Jun. 27, 2013

(65) Prior Publication Data

US 2014/0134858 A1 May 15, 2014

(30) Foreign Application Priority Data

Nov. 9, 2012 (TW) ..... 101141712 A

(51) Int. Cl.

| | |
|---|---|
| ***H01R 13/44*** | (2006.01) |
| ***H01R 13/447*** | (2006.01) |
| ***H01R 13/453*** | (2006.01) |
| ***H01R 13/52*** | (2006.01) |

(Continued)

(52) U.S. Cl.

CPC ..... *H01R 13/447* (2013.01); *H01R 13/453* (2013.01); *H01R 13/5213* (2013.01); *H01R 13/6395* (2013.01); *H01R 24/64* (2013.01); *H01R 2201/06* (2013.01)

(58) Field of Classification Search

CPC ..... H01R 13/447; H01R 13/453; H01R 13/4532; H01R 13/5213

USPC ..... 439/136, 135, 137, 138, 142

See application file for complete search history.

(56) References Cited

U.S. PATENT DOCUMENTS 5,738,536 A * 4/1998 Ohgami et al. ..... 439/142
5,738,546 A * 4/1998 Burroughs et al. ..... 439/620.03

(Continued)

FOREIGN PATENT DOCUMENTS

| | | | |
|---|---|---|---|
| CN | 102983456 | A | 3/2013 |
| TW | M418437 | U1 | 12/2011 |
| TW | M430057 | U1 | 5/2012 |

OTHER PUBLICATIONS

Office action mailed on Feb. 12, 2015 for the Taiwan application No. 101141712, filing date: Nov. 9, 2012, p. 1 line 10-14, p. 2-5 and p. 6 line 1-19.

(Continued)

*Primary Examiner* — Neil Abrams
*Assistant Examiner* — Travis Chambers
(74) *Attorney, Agent, or Firm* — Winston Hsu; Scott Margo

(57) ABSTRACT

A connecter mechanism includes a casing, a half socket and a door. The casing includes a first actuating portion, an opening and a pivot hole. The half socket is disposed inside the casing. The door is movably disposed on the casing to cover the half socket. The door includes a body, at least one pivot shaft, a cover and a second actuating portion. The pivot shaft is disposed on a side of the body. The cover is connected to an edge of the body for covering the opening. The second actuating portion is connected to the other edge of the body opposite to the cover. Position of the cover relative to the opening is adjusted via the second actuating portion and the first actuating portion.

20 Claims, 9 Drawing Sheets

(51) Int. Cl.
*H01R 13/639* (2006.01)
*H01R 24/64* (2011.01)

(56) References Cited

U.S. PATENT DOCUMENTS 7,687,711 B2 * 3/2010 Kutaragi et al. ..... 174/50
8,259,445 B2 * 9/2012 Skillman et al. ..... 361/679.58
8,337,222 B2 * 12/2012 Hung et al. ..... 439/138
8,355,260 B2 * 1/2013 Kang ..... 361/752
8,419,459 B2 * 4/2013 Nihei et al. ..... 439/341
8,435,054 B2 * 5/2013 Liu ..... 439/142
8,573,990 B2 * 11/2013 Cheng et al. ..... 439/135
8,636,525 B2 * 1/2014 Sobig et al. ..... 439/136
8,764,465 B2 * 7/2014 Huang ..... 439/138
8,926,345 B2 * 1/2015 Kim et al. ..... 439/142
2010/0248554 A1 * 9/2010 Hung et al. ..... 439/676
2013/0023136 A1 * 1/2013 Kim et al. ..... 439/153
2013/0130523 A1 * 5/2013 Chen ..... 439/136

OTHER PUBLICATIONS

Office action mailed on Jun. 23, 2015 for the China application No. 201210514960.0, p. 3 line 4~19, p. 4~8 and p. 9 line 1~19.

* cited by examiner

CONNECTOR MECHANISM AND RELATED ELECTRONIC DEVICE

BACKGROUND OF THE INVENTION

1. Field of the Invention

The present disclosure relates to a connector mechanism and a related electronic device, and more particularly, to a thin-typed connector mechanism and a related electronic device.

2. Description of the Prior Art

With the development of information and computer technology, the size of a computer is becoming smaller and the computer is utilized in a wide variety of fields. In order to expand functions of a computer system for satisfying user's various demands, various external devices of the computer system come with the trend. For example, an external hard disk drive and a portable storage device can expand the memory capacity of the computer system. An external optical disk drive and an optical disk writer can expand multimedia access function of the computer system. A network cable allows the computer system to be connected to an internet so as to gather information online or surf webpage. However, because of the thinning size of the notebook computer, it brings more challenges for mechanical design. Connecting ports disposed on a side of the notebook computer will constrain the thickness of mechanism of the notebook computer.

For example, an Ethernet port (such as a RJ 45 port) for connecting to network or RJ11 port for connecting a telephone cable has a fixed size of the opening. So, the notebook computer needs to increase its thickness in order to match the size of the connecting ports. Alternatively, the network port or the telephone port is exposed out of the notebook computer so as to affect an aesthetic feeling of appearance. Thus, the conventional connector mechanism has importance issues of satisfying the height specification as well as keeping the aesthetic feeling of appearance.

SUMMARY OF THE INVENTION

The present disclosure provides a thin-typed connector mechanism and a related electronic device for solving above drawbacks.

According to the claimed disclosure, a connector mechanism for connecting to an external plug is disclosed. The connector mechanism includes a casing, a half socket and a door. The casing includes a first actuating portion, an opening and a pivot hole. The half socket is disposed inside the casing. The door is movably disposed on the casing for covering the half socket. The door includes a body, at least one pivot shaft, a cover and a second actuating portion. The pivot shaft is disposed on a side of the body. The pivot shaft rotatably inserts into the pivot hole. The cover is connected to an edge of the body for covering the opening. The second actuating portion is connected to the other edge of the body opposite to the cover. Position of the cover relative to the opening is adjusted via the second actuating portion and the first actuating portion.

According to the claimed disclosure, the half socket is suspended on an upper wall inside the casing. The door pivots to a low wall inside the casing. The opening is located between the upper wall and the low wall, and the pivot hole is formed on the low wall.

According to the claimed disclosure, a distance between the pivot shaft and a top of the half socket is substantially greater than a thickness of the external plug.

According to the claimed disclosure, the first actuating portion is a contacting block, the second actuating portion is a curved plank, an end of the curved plank contacts against the contacting block.

According to the claimed disclosure, the curved plank is made of resilient material. The curved plank rotates the body relative to the casing via the pivot shaft, so as to dispose the cover on the opening.

According to the claimed disclosure, the curved plank rotates the body relative to the casing, so that the cover contacts against a pin of the external plug.

According to the claimed disclosure, a part of the curved plank contacts against the external plug to constrain a movement of the external plug relative to the half socket.

According to the claimed disclosure, the first actuating portion includes a plurality of sunken structures, and the second actuating portion includes at least one protrusion. The protrusion is detachably engaged with the corresponding sunken structure.

According to the claimed disclosure, the protrusion is engaged with the sunken structure to position the cover relative to the opening.

According to the claimed disclosure, the second actuating portion further includes two boards, the boards buckle the external plug to constrain a movement of the external plug relative to the half socket.

According to the claimed disclosure, the door further includes a strengthening rib and a blocking rib. The strengthening rib is disposed on an inner surface of the body and connected to the cover. The blocking rib is disposed on the inner surface of the body and connected to the strengthening rib. A structural height of the blocking rib is substantially greater than a structural height of the strengthening rib.

According to the claimed disclosure, an electronic device includes a casing and a connector mechanism. At least one electronic component is disposed inside the casing. The casing includes an opening, a pivot hole and a first actuating portion. The connector mechanism is for connecting to an external plug. The connector mechanism includes a half socket and a door. The casing includes a first actuating portion, an opening and a pivot hole. The half socket is disposed inside the casing. The door is movably disposed on the casing for covering the half socket. The door includes a body, at least one pivot shaft, a cover and a second actuating portion. The pivot shaft is disposed on a side of the body. The pivot shaft rotatably inserts into the pivot hole. The cover is connected to an edge of the body for covering the opening. The second actuating portion is connected to the other edge of the body opposite to the cover. Position of the cover relative to the opening is adjusted via the second actuating portion and the first actuating portion.

The present disclosure has advantages of easy structure, convenient operation and low manufacturing cost. Dimension of the connector mechanism of the present disclosure can be effectively decreased without effect of structural intensity of the cover. The present disclosure improves drawback of the weak intensity of the conventional connector, and conforms to a trend of the thin-typed electronic device for preferable market competition.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
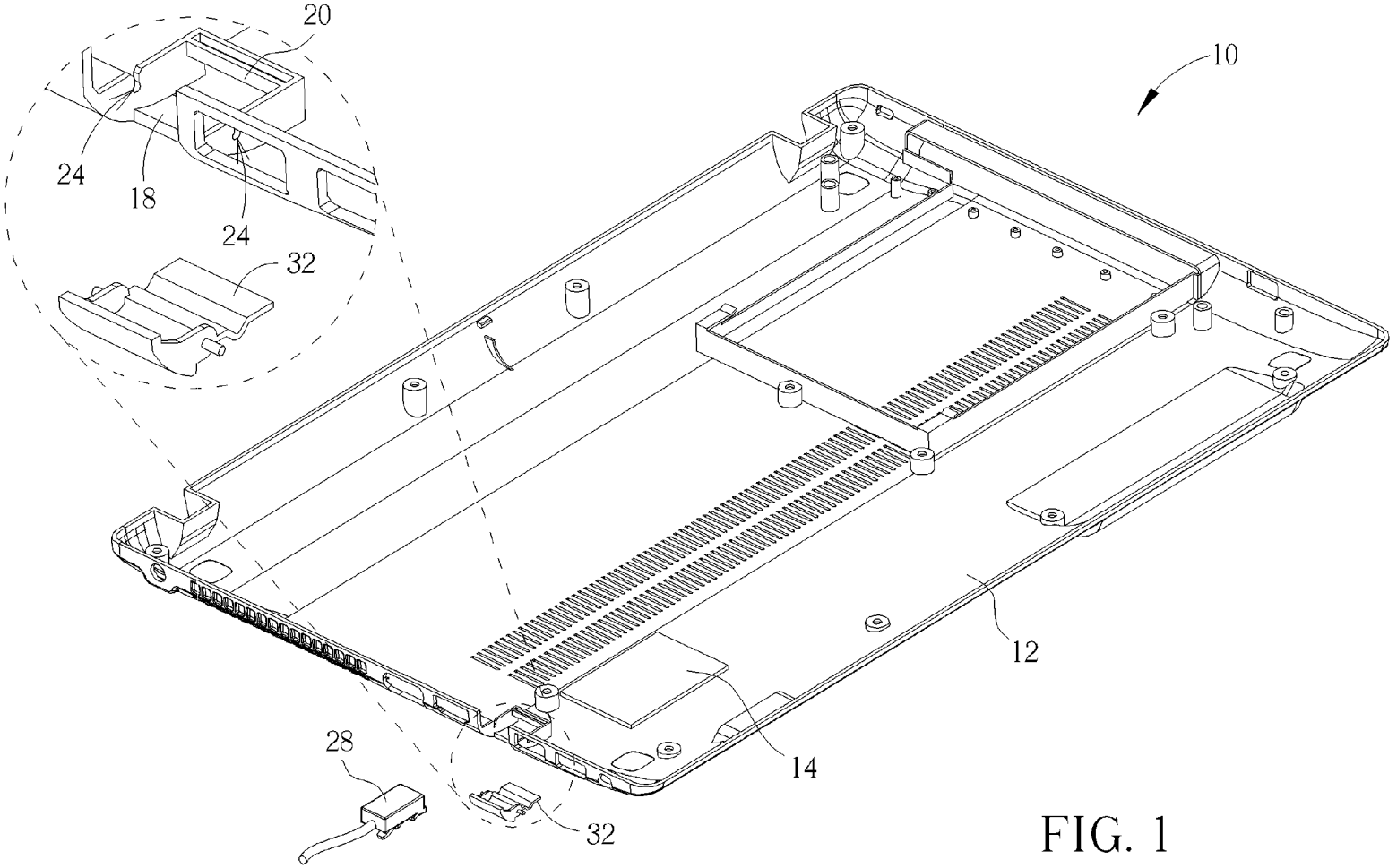
FIG. 1 is a diagram of an electronic device according to a first embodiment of the present disclosure.
Figure 2:
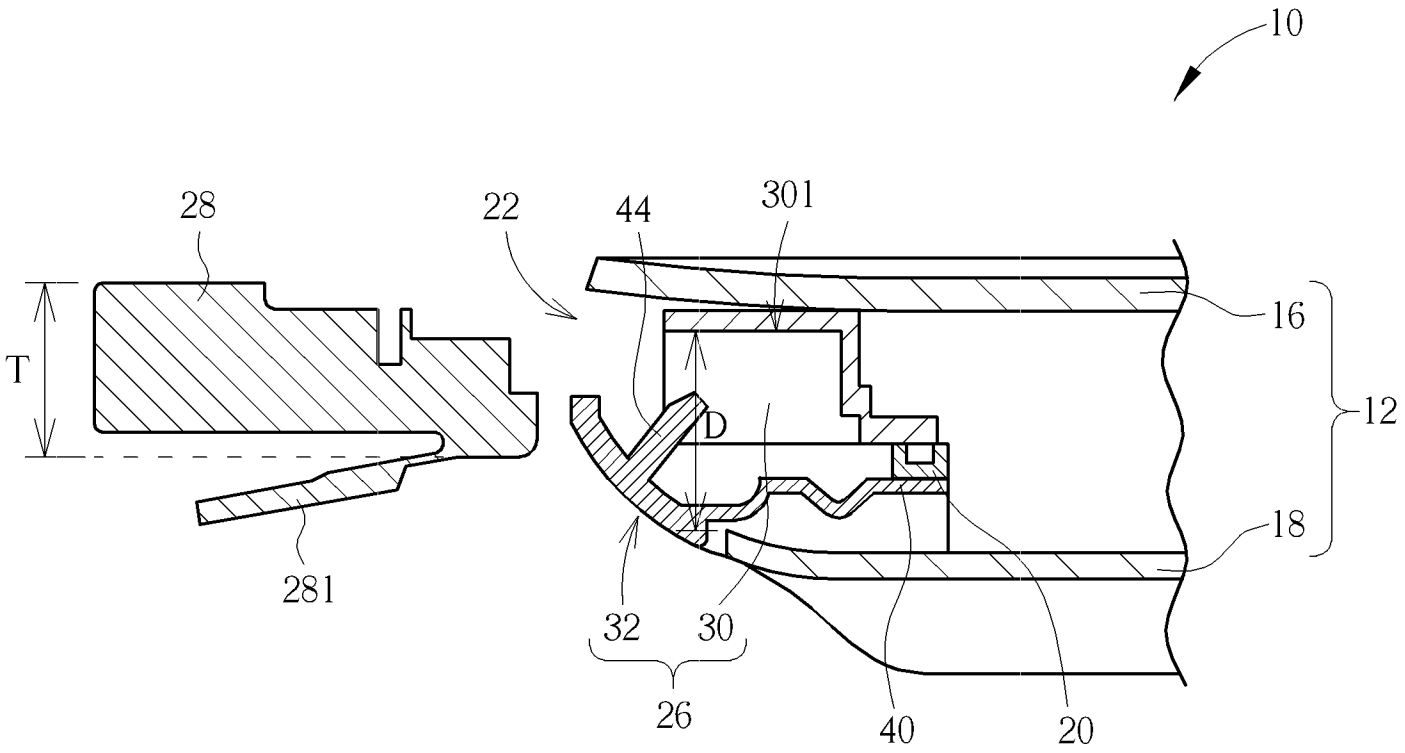
FIG. 2 is a sectional view of the electronic device according to the first embodiment of the present disclosure.

Please refer to FIG. 1 and FIG. 2. FIG. 1 is a diagram of an electronic device 10 according to a first embodiment of the present disclosure. FIG. 2 is a sectional view of the electronic device 10 according to the first embodiment of the present disclosure. The electronic device 10 includes a casing 12. At least one electronic component 14 is disposed inside the casing 12. The electronic component 14 can be a motherboard, a processor, a hard disk and so on. As shown in FIG. 2, the casing 12 includes an upper wall 16, a low wall 18 and a first actuating portion 20. An opening 22 is formed between the upper wall 16 and the low wall 18. Two pivot holes 24 are formed on the low wall 18. The electronic device 10 further includes a connector mechanism 26 for connecting to an external plug 28. Generally, the electronic device 10 can be a notebook computer or a tablet computer. The connector mechanism 26 can be a universal serial bus (USB) socket, and the external plug 28 can be the USB plug.

Figure 3:
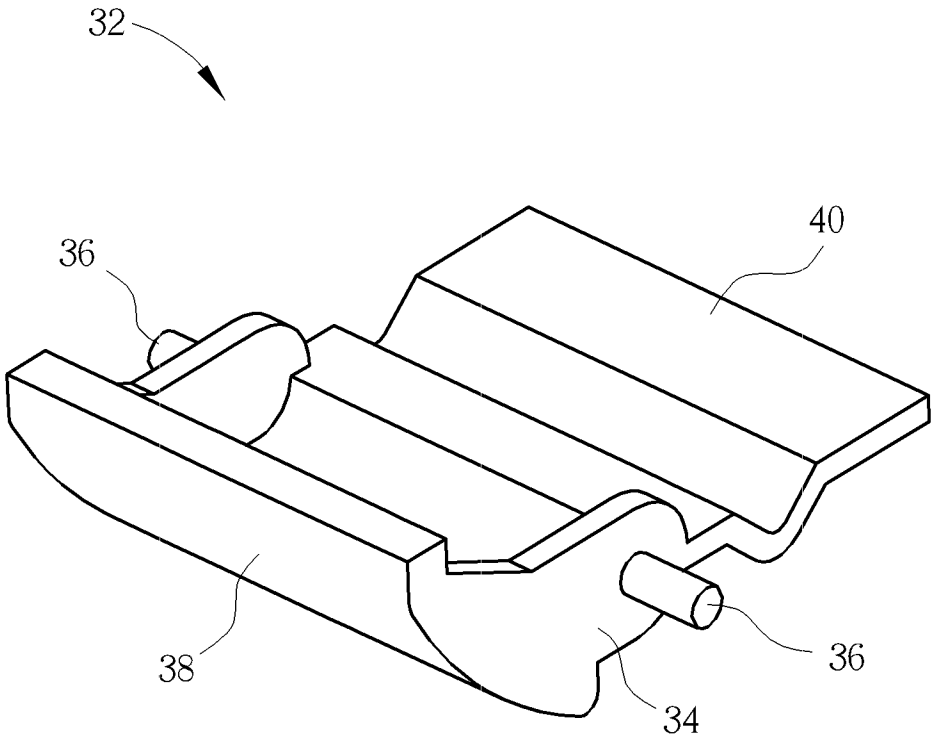
FIG. 3 is a diagram of a door according to the first embodiment of the present disclosure.

As shown in FIG. 1, the connector mechanism 26 includes a half socket 30 and a door 32. A thickness of the half socket 30 is smaller than a thickness of the conventional socket, so the half socket 30 is preferably applied to the casing 12 of the thin-typed electronic device 10. The door 32 is movably disposed on the casing 12 for covering the half socket 30, to provide artistic appearance and dustproof function. Please refer to FIG. 3. FIG. 3 is a diagram of the door 32 according to the first embodiment of the present disclosure. The door 32 includes a body 34, two pivot shafts 36, a cover 38 and a second actuating portion 40. The pivot shafts 36 are respectively disposed on two opposite sides of the body 34, and each pivot shaft 36 rotatably inserts into the corresponding pivot hole 24 on the casing 12. The cover 38 and the second actuating portion 40 are respectively connected to two opposite edges of the body 34. The cover 38 can be disposed on or be separated from the opening 22 according to rotation of the body 38 relative to the casing 12. The second actuating portion 40 can be cooperated with the first actuating portion 20 to adjust position (the relative angle) of the cover 38 relative to the opening 22.

In the embodiment of the present disclosure, the half socket 30 can be suspended on the upper wall 16, and the door 32 can pivot to the low wall 18, which means the half socket 30 does not contact the door 32. The external plug 28 can be accommodated inside a gap between the half socket 30 and the door 32. The upper wall 16 is an upper structural unit of the casing 12, the low wall 18 is a low structural unit of the casing 12, and the opening 22 is located between the upper wall 16 and the low wall 18. Dimension of the door 32 is substantially smaller than dimension of the opening 22. The door 32 can not fully cover the opening 22, and the user can manually open the door 32 via the chink, so as to expose the opening 22 for the external plug 28. In addition, a distance D between the pivot shaft 36 and the top 301 of the half socket 30 is substantially greater than a thickness T of the external plug 28, so as to ensure that the external plug 28 can accurately connect to the connector mechanism 26. As the connector mechanism 26 is not in use, the door 32 covers the opening 22 to form an inclined shape on an edge of the casing 12, so that the electronic device 10 of the preset disclosure has advantages of thin-typed appearance and adjustable connector mechanism 26.

Figure 4:
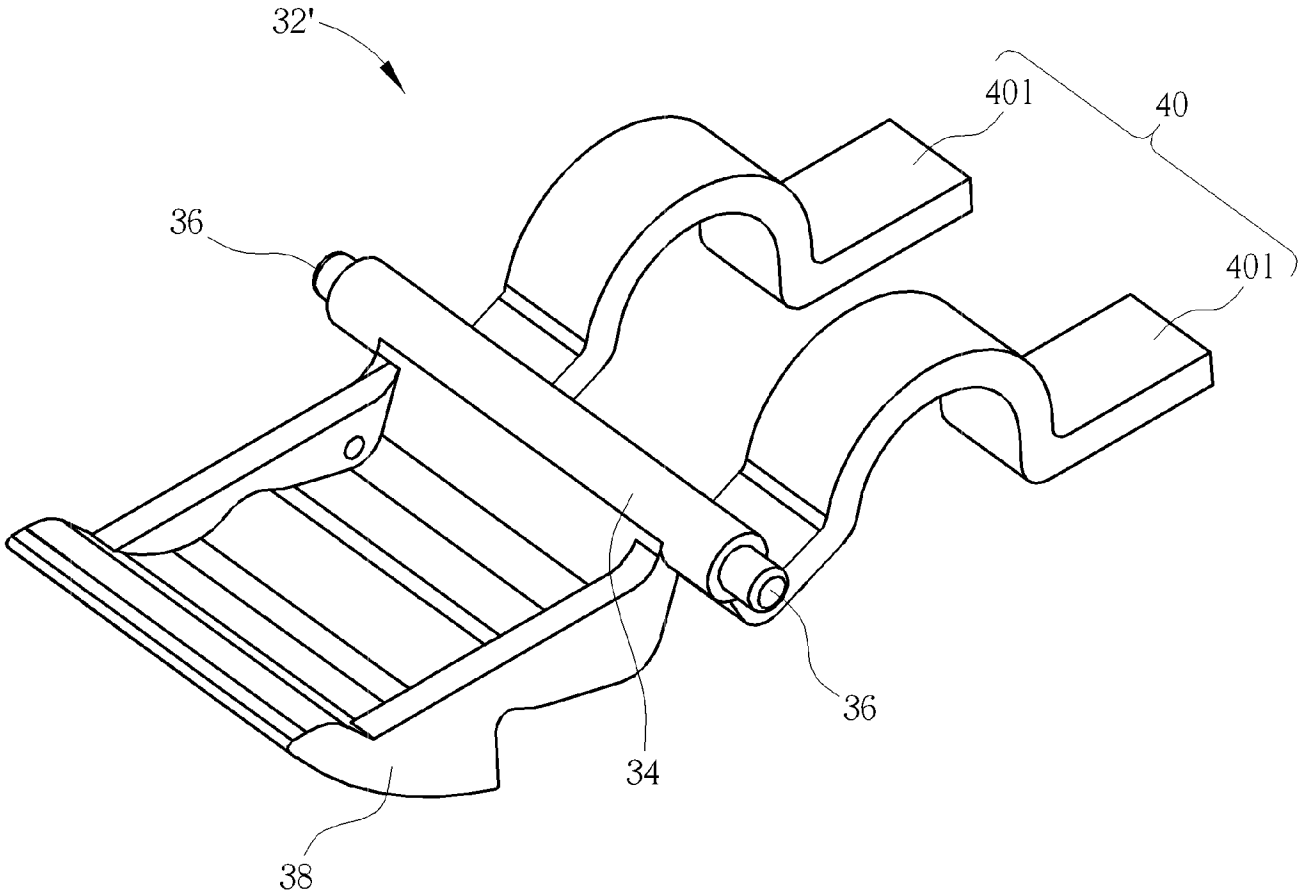
FIG. 4 is a diagram of the door according to the other embodiment of the present disclosure.

As shown in FIG. 2 and FIG. 3, the first actuating portion 20 of the connector mechanism 26 in the first embodiment can be a contacting block, and the second actuating portion 40 can be a curved plank. The curved plank is made of resilient material, and the curved plank can be the one-piece folding structure in order to strengthen material resilience of the curved plank. Please refer to FIG. 4. FIG. 4 is a diagram of a door 32' according to the other embodiment of the present disclosure. In the embodiment, elements having the same numeral as ones of the above-mentioned embodiment have the same structure and function, and detailed description is omitted herein for simplicity. Special of this embodiment is that the second actuating portion 40 of the door 32' can include a plurality of boards 401, such as two boards 401 shown in FIG. 4. A curved bending structure can be disposed on middle of each board 401, so as to decrease the material rigidity of the second actuating portion 40, and to increase the material resilience of the second actuating portion 40 (the curved plank).

Figure 5:
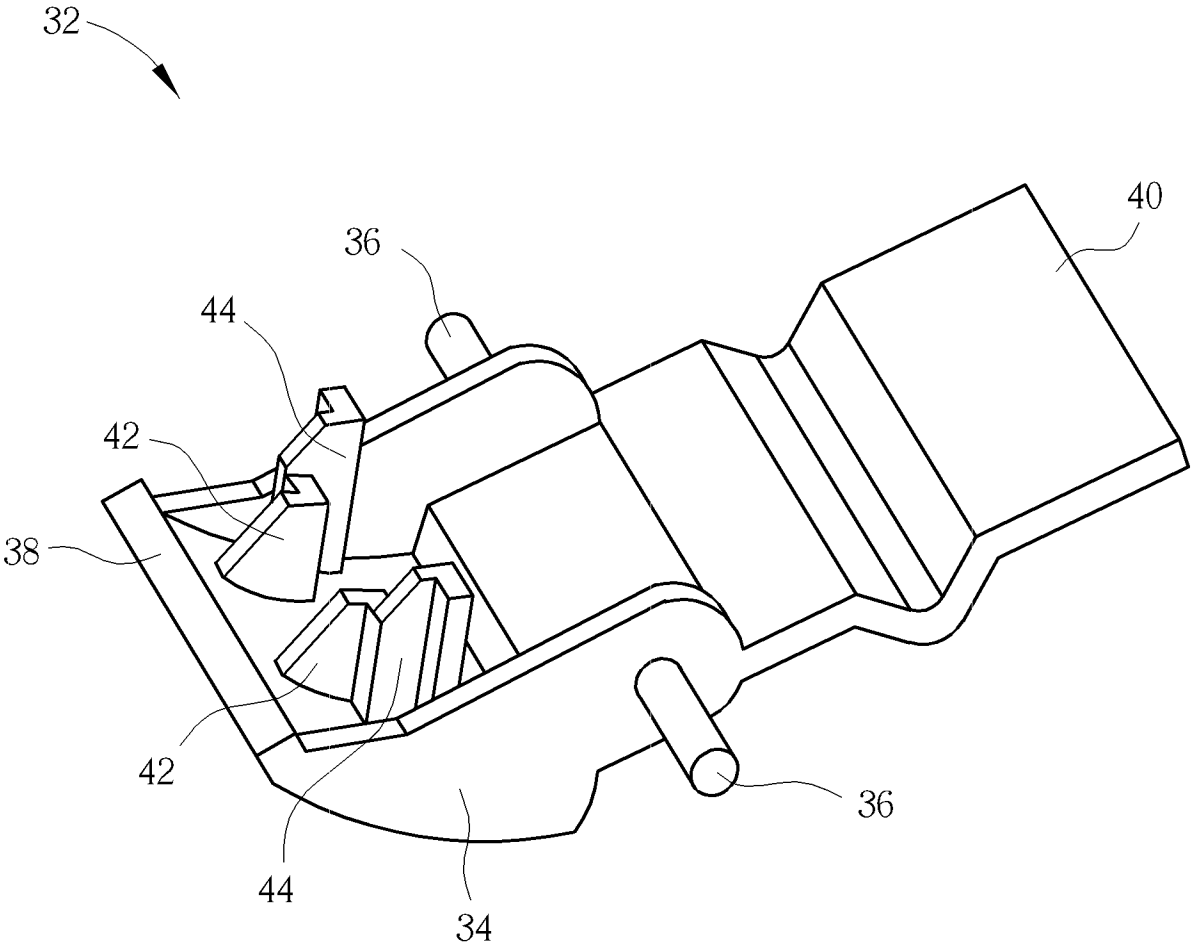
FIG. 5 is a diagram of the door in the other view in FIG. 3.

Please refer to FIG. 5. FIG. 5 is a diagram of the door 32 in the other view in FIG. 3. The door 32 further includes two strengthening ribs 42 and two blocking ribs 44. The strengthening ribs 42 are disposed on an inner surface of the body 34 and connected to the cover 38, so as to increase the structural rigidity of the cover 38. Each blocking rib 44 is disposed on the inner surface of the body 34 and connected to the corresponding strengthening rib 42. A structural height H1 of the blocking rib 44 is substantially greater than a structural height H2 of the strengthening rib 42. Therefore, the blocking rib 44 can contact against the bottom of the external plug 28 when the external plug 28 inserts into the connector mechanism 26. A gap is formed between the strengthening rib 42 and the external plug 28, which means structural height difference between the blocking rib 44 and the strengthening rib 42. The pin 281 can move inside the above-mentioned gap without simultaneous movement of the cover 38.

Figure 6:
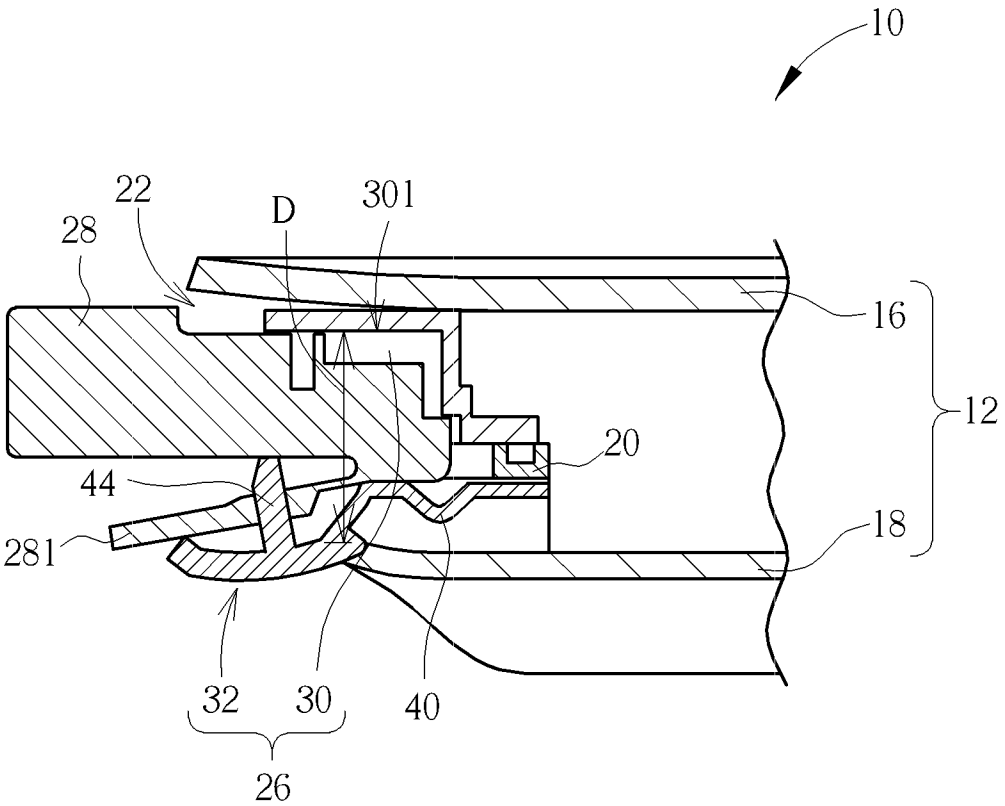
FIG. 6 is a sectional view of the electronic device in the other operational mode in FIG. 1.

Please refer to FIG. 2 to FIG. 6. FIG. 6 is a sectional view of the electronic device 10 in the other operational mode in FIG. 1. An end of the second actuating portion 40 (the curved plank), which is not connected to the body 34, can contact against the first actuating portion 20 (the contacting block). As shown in FIG. 2, the external plug 28 does not insert into the casing 12, the resilient recovering force of the second actuating portion 40 rotates the body 34 relative to the casing 12 via a combination of the pivot shaft 36 and the pivot hole 24, so as to dispose the cover 38 on the opening 22. As shown in FIG. 6, the cover 38 is forced to assemble the external plug 28. The second actuating portion 40 is resiliently deformed when the cover 38 is pressed, and the door 32 rotates relative to the casing 12 to expose the half socket 30. The external plug 28 inserts into the opening 22 to be electrically connected to the half socket 30. When the force applied to the door 32 is removed, the resilient recovering force of the second actuating portion 40 rotates the body 34 relative to the casing 12 at the counterclockwise direction, so that the cover 38 presses a pin 281 of the external plug 28, and the contacting rib 44 contacts against the bottom of the external plug 28.

The cover 38 can contact against the pin 281 via an engagement (not shown in figures) to constrain a movement of the external plug 28 and to prevent the external plug 28 from separation from the connector mechanism 26. In addition, a part of the second actuating portion 40 can contact against the low surface of the external plug 28, which means the connector mechanism 26 can utilize the second actuating portion 40 and the top 301 of the half socket 30 to buckle the external plug 28, so as to constrain the movement of the external plug 28 relative to the half socket 30. For disassembling the external plug 28, the pin 281 is pressed to be close to the bottom of the external plug 28, and the pin 281 can be spaced from the above-mentioned engagement of the cover 38. Meanwhile, the blocking rib 44 contacts against the bottom of the external lug 28, the cover 38 moves with the pin 281 to press the external plug 28, and the external plug 28 can move out of the connector mechanism 26 easily.

Figure 7:
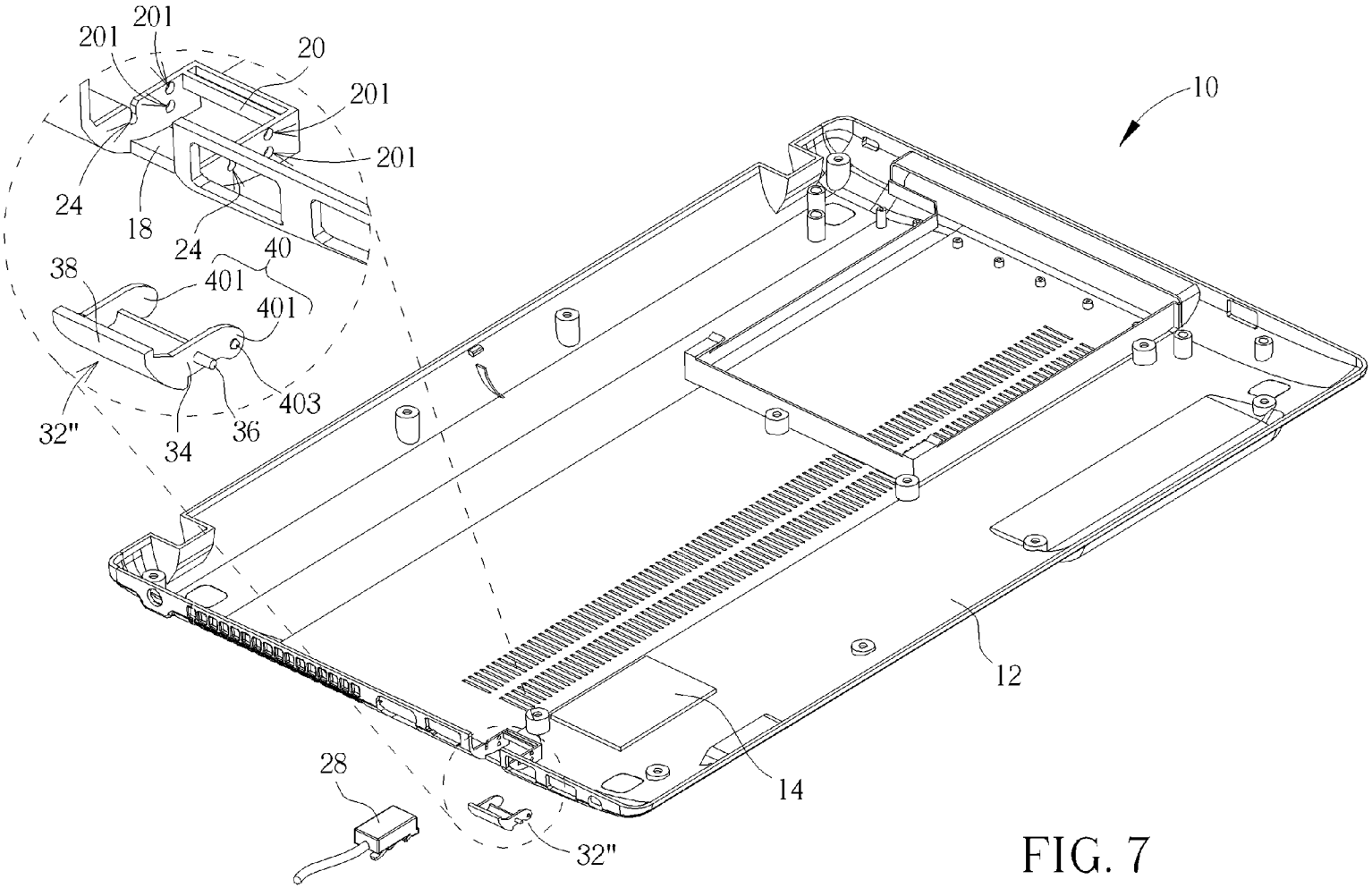
FIG. 7 is a diagram of the electronic device and the door according to a second embodiment of the present disclosure.
Figure 8:
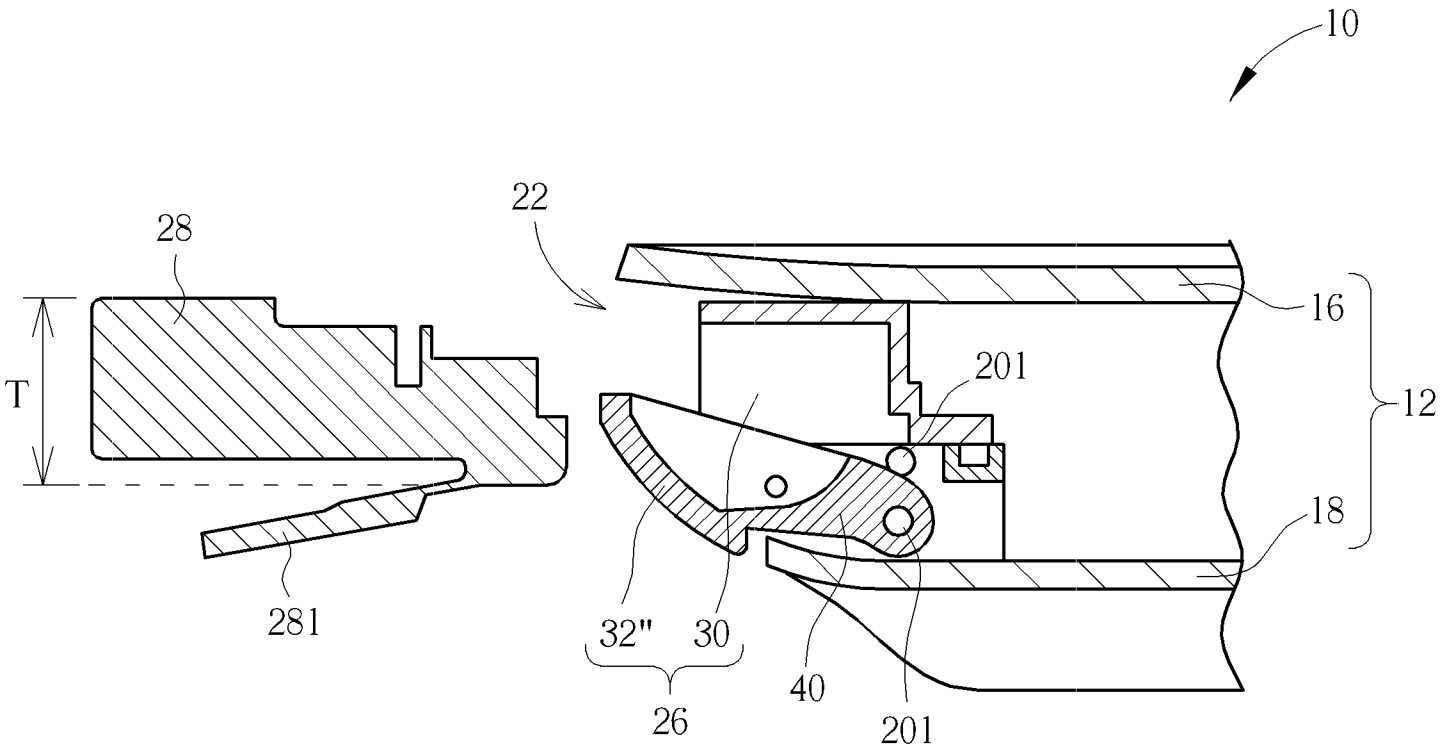
FIG. 8 and FIG. 9 respectively are diagrams of the electronic device in different operational modes according to the second embodiment of the present disclosure.
Figure 9:
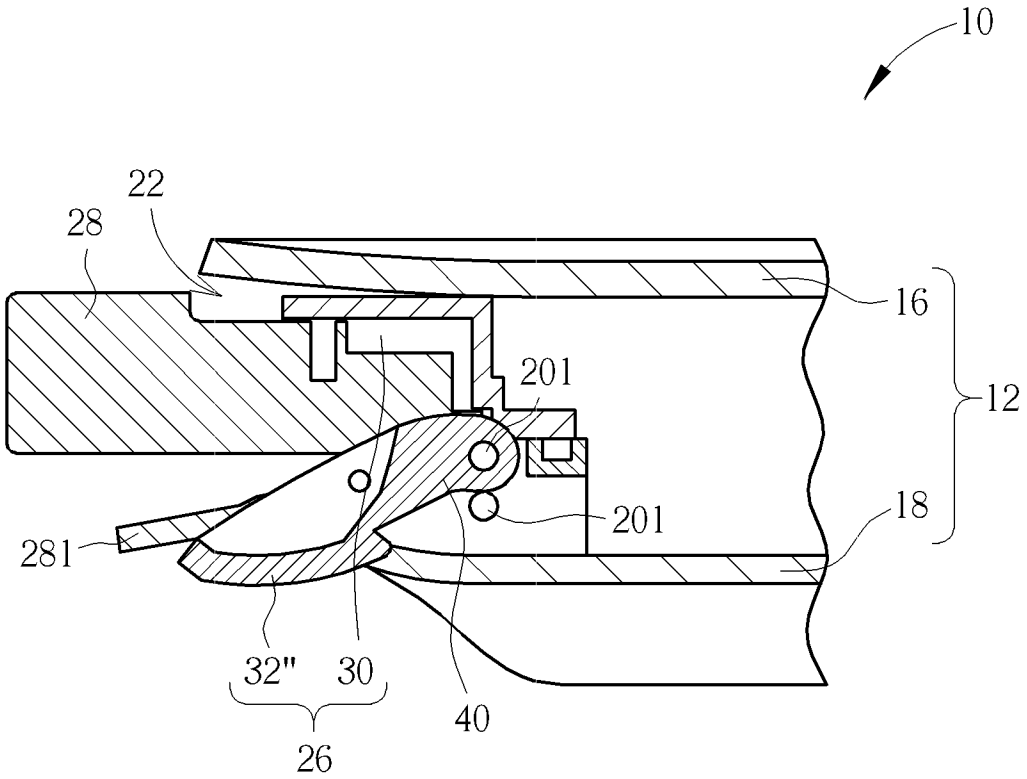

Please refer to FIG. 7 to FIG. 9. FIG. 7 is a diagram of the electronic device 10 and the door 32" according to a second embodiment of the present disclosure. FIG. 8 and FIG. 9 respectively are diagrams of the electronic device 10 in different operational modes according to the second embodiment of the present disclosure. In the second embodiment, elements having the same numeral as ones of the first embedment have the same structure and function, and detailed description is omitted herein for simplicity. Difference between the first embodiment and the second embodiment is that the first actuating portion 20 of the electronic device 10 can further include a plurality of sunken structures 201, and the second actuating portion 40 of the door 32" can further include at least one protrusion 403. The protrusion 403 moves between the sunken structures 201 according to rotation of the door 32".

Generally, the first actuating portion 20 can preferably include two sunken structures 201. As shown in FIG. 8, the protrusion 403 of the door 32" is engaged with the low sunken structure 201, and the cover 38 can cover the opening 22 to close the connector mechanism 26. For assembling the external plug 28, as shown in FIG. 9, the cover 38 is forced to separate the protrusion 403 of the door 32" from the low sunken structure 201, and then the protrusion 403 moves upwardly to be engaged with the upper sunken structure 201. Meanwhile, the door 32" is constrained by the combination of the first actuating portion 20 (the sunken structure 201) and the second actuating portion 40 (the protrusion 403) to expose the opening 22, so the external plug 28 can arbitrarily insert into or be removed from the opening 22 without structural interference between the external plug 28 and the door 32". Furthermore, the second actuating portion 40 of the door 32" of the second embodiment can further include two boards 401, which is different from the board in the first embodiment. The boards 401 can buckle two sides of the external plug 28 to prevent the external plug 28 from separation from the half socket 30.

In conclusion, the present disclosure utilizes the half socket to decrease the thickness of the connector mechanism, and the half socket is cooperated with the rotatable door to manually expand the opening for the external plug, so that the connector mechanism of the present disclosure can be applied to the thin-typed electronic device. The second actuating portion of the door has different shapes and functions according to variation of the first actuating portion of the casing. As the second actuating portion is the resilient curved plank, the second actuating portion can drive the cover to automatically cover the opening when the external plug does not insert into the half socket, so as to effectively prevent the dust and liquid from falling into the casing for protection of the half socket and the electronic component.

Besides, a positioning mechanism can be set by the first actuating portion and the second actuating portion. The second actuating portion can utilize the structural interference with the first actuating portion to dispose the cover on the opening and to separate the cover from the opening. The present disclosure can further combine the resilient design and the positioning design of the above-mentioned embodiments, which means the engaging protrusion of the second embodiment can be disposed by the curved plank of the first embodiment, so that the protrusion can move from the sunken structure to the other sunken structure via the resilient recovering force of the curved plank. Structural combination and disposition of the present disclosure are not limited to the above-mentioned embodiments, and depend on design demand.

Comparing to the prior art, the present disclosure has advantages of easy structure, convenient operation and low manufacturing cost. Dimension of the connector mechanism of the present disclosure can be effectively decreased without effect of structural intensity of the cover. The present disclosure improves drawback of the weak intensity of the conventional connector, and conforms to a trend of the thin-typed electronic device for preferable market competition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector mechanism for connecting to an external plug, the connector mechanism comprising:

a casing, the casing comprising a first actuating portion, an opening and a pivot hole, the first actuating portion being undeformably disposed by the opening and the pivot hole;

a half socket disposed inside the casing; and a door movably disposed on the casing for covering the half socket, the door comprising:

a body;

at least one pivot shaft disposed on a side of the body, the pivot shaft rotatably inserting into the pivot hole, a distance between the pivot shaft and a top of the half socket being substantially greater than a thickness of the external plug;

a cover connected to an edge of the body for covering the opening; and a second actuating portion deformably connected to the other edge of the body opposite to the cover and deformably contacting against the first actuating portion, position of the cover relative to the opening being adjusted via deformation of the second actuating portion relative to the first actuating portion.

2. The connector mechanism of claim 1, wherein the half socket is suspended on an upper wall inside the casing, the door pivots to a low wall inside the casing, the opening is located between the upper wall and the low wall, and the pivot hole is formed on the low wall.

3. The connector mechanism of claim 1, wherein the door further comprises:

a strengthening rib disposed on an inner surface of the body and connected to the cover; and a blocking rib disposed on the inner surface of the body and connected to the strengthening rib, a structural height of the blocking rib being substantially greater than a structural height of the strengthening rib.

4. The connector mechanism of claim 1, wherein the first actuating portion is a contacting block, the second actuating portion is a curved plank, an end of the curved plank contacts against the contacting block.

5. The connector mechanism of claim 4, wherein a part of the curved plank contacts against the external plug to constrain a movement of the external plug relative to the half socket.

6. The connector mechanism of claim 4, wherein the curved plank is made of resilient material, the curved plank rotates the body relative to the casing via the pivot shaft, so as to dispose the cover on the opening.

7. The connector mechanism of claim 6, wherein the curved plank rotates the body relative to the casing, so that the cover contacts against a pin of the external plug.

8. The connector mechanism of claim 1, wherein the first actuating portion comprises a plurality of sunken structures, the second actuating portion comprises at least one protrusion, the protrusion is detachably engaged with the corresponding sunken structure.

9. The connector mechanism of claim 8, wherein the protrusion is engaged with the sunken structure to position the cover relative to the opening.

10. The connector mechanism of claim 8, wherein the second actuating portion further comprises two boards, the boards buckle the external plug to constrain a movement of the external plug relative to the half socket.

11. An electronic device comprising:

a casing whereinside at least one electronic component is disposed, the casing comprising an opening, a pivot hole and a first actuating portion, the first actuating portion being undeformably disposed by the opening and the pivot hole; and a connector mechanism for connecting to an external plug, the connector mechanism comprising:

a half socket electrically connected to the electronic component and disposed inside the casing; and a door movably disposed on the casing for covering the half socket, the door comprising:

a body;

at least one pivot shaft disposed on a side of the body, the pivot shaft rotatably inserting into the pivot hole, a distance between the pivot shaft and a top of the half socket being substantially greater than a thickness of the external plug;

a cover connected to an edge of the body for covering the opening; and a second actuating portion deformably connected to the other edge of the body opposite to the cover and deformably contacting against the first actuating portion, position of the cover relative to the opening being adjusted via deformation of the second actuating portion relative to the first actuating portion.

12. The electronic device of claim 11, wherein the half socket is suspended on an upper wall inside the casing, the door pivots to a low wall inside the casing, the opening is located between the upper wall and the low wall, and the pivot hole is formed on the low wall.

13. The electronic device of claim 11, wherein the door further comprises:

a strengthening rib disposed on an inner surface of the body and connected to the cover; and a blocking rib disposed on the inner surface of the body and connected to the strengthening rib, a structural height of the blocking rib being substantially greater than a structural height of the strengthening rib.

14. The electronic device of claim 11, wherein the first actuating portion is a contacting block, the second actuating portion is a curved plank, an end of the curved plank contacts against the contacting block.

15. The electronic device of claim 14, wherein a part of the curved plank contacts against the external plug to constrain a movement of the external plug relative to the half socket.

16. The electronic device of claim 14, wherein the curved plank is made of resilient material, the curved plank rotates the body relative to the casing via the pivot shaft, so as to dispose the cover on the opening.

17. The electronic device of claim 16, wherein the curved plank rotates the body relative to the casing, so that the cover contacts against a pin of the external plug.

18. The electronic device of claim 11, wherein the first actuating portion comprises a plurality of sunken structures, the second actuating portion comprises at least one protrusion, the protrusion is detachably engaged with the corresponding sunken structure.

19. The electronic device of claim 18, wherein the protrusion is engaged with the sunken structure to position the cover relative to the opening.

20. The electronic device of claim 18, wherein the second actuating portion further comprises two boards, the boards buckle the external plug to constrain a movement of the external plug relative to the half socket.

* * * * *